US007246385B2

(12) United States Patent
Dennis et al.

(10) Patent No.: US 7,246,385 B2
(45) Date of Patent: Jul. 24, 2007

(54) HELMET CHIN-STRAP HARNESS STRUCTURE

(75) Inventors: Michael R. Dennis, Scappoose, OR (US); Gerhard Paasche, Scappoose, OR (US)

(73) Assignee: MJD Innovations, L.L.C., Scappoose, OR (US)

( * ) Notice: Subject to any disclaimer, the term of this patent is extended or adjusted under 35 U.S.C. 154(b) by 0 days.

(21) Appl. No.: 11/082,622

(22) Filed: Mar. 17, 2005

(65) Prior Publication Data

US 2006/0010583 A1 Jan. 19, 2006

Related U.S. Application Data

(60) Provisional application No. 60/587,888, filed on Jul. 14, 2004.

(51) Int. Cl.
*A42B 7/00* (2006.01)

(52) U.S. Cl. ..... 2/421

(58) Field of Classification Search ..... 2/421, 2/417, 418, 419, 420, 6.6, 6.7, 425
See application file for complete search history.

(56) References Cited

U.S. PATENT DOCUMENTS 2,340,872 A * 2/1944 Flynn et al. ..... 2/6.6
2,383,597 A * 8/1945 Feman ..... 2/6.6
3,009,158 A * 11/1961 Comeau et al. ..... 2/437
3,105,240 A * 10/1963 Jansson ..... 2/420
3,190,973 A * 6/1965 Aileo ..... 381/372
3,787,895 A * 1/1974 Belvedere ..... 2/9
4,692,947 A * 9/1987 Black et al. ..... 2/421
4,970,589 A * 11/1990 Hanson et al. ..... 348/158
5,809,580 A * 9/1998 Arnette ..... 2/426
6,108,824 A * 8/2000 Fournier et al. ..... 2/418
6,289,522 B1 * 9/2001 Jones et al. ..... 2/425
6,804,829 B2 10/2004 Crye et al.
D503,846 S * 4/2005 Gallagher et al. ..... D2/881
2003/0135914 A1 * 7/2003 Racine et al. ..... 2/413

* cited by examiner

*Primary Examiner*—Rodney Lindsey
(74) *Attorney, Agent, or Firm*—Jon M. Dickinson, PC; Robert D. Varitz, PC

(57) ABSTRACT

Helmet chin-strap harness structure including a pair of bilaterally symmetric, bilaterally equi-flex, non-rigid, fabric-strap-like, substantially mirror-image, flexible lateral elements which define opposite sides for the harness structure, and a bilaterally symmetric chin-strap substructure having laterally opposite sides releasably attachable for fore-and-aft translational sliding on the two lateral elements.

9 Claims, 3 Drawing Sheets

HELMET CHIN-STRAP HARNESS STRUCTURE

CROSS-REFERENCE TO RELATED APPLICATION

This patent application claims priority to prior-filed, co-pending U.S. Provisional Patent Application Ser. No. 60/587,888 filed Jul. 14, 2004, for "Helmet Chin-Strap Suspension Harness". The entire disclosure content of this prior-filed provisional application is hereby incorporated herein by reference.

BACKGROUND AND SUMMARY OF THE INVENTION

This invention relates to a novel self-load-balancing chin-strap harness structure (or chin-strap system) for use in a protective, safety helmet—a kind of nominally unconstrained, "self-seeking" structure which addresses a number of significant disadvantages found in conventional harness structures of this general character. As will be seen, the concept "nominally unconstrained" refers to the fact that the structure and implementation of this invention include almost nothing in the way of rigidly configured, non-moveably anchored (at least with respect to certain appropriate degrees of freedom of motion) characteristics, insofar as permitting this structure to self-seek a true load-balanced proper condition when employed with a safety helmet. Flexible and pliable fabric-like components, along with a pair of lateral sliding connections, lead to this important performance quality of the invention.

In connection with the disclosure of this invention herein, two special descriptive words/expressions are employed with respect to certain structural characterizations of the invention. These expressions are "symmetriflex" and "symmetriload".

The term "symmetriflex" refers to a quality of the harness structure of the invention involving bilateral symmetry of component flexibility which is offered by the fabric, strap-like, pliable and flexible materials employed substantially entirely/throughout the various elements of the invention. This quality is generally lacking in conventional prior art chin-strap harness structures, wherein, for example, laterally offset, laterally "unbalanced" rigid-body, strap-connection hardware, typically associated with a chin-strap unit per se, is employed.

The term "symmetriload" refers to another quality of the invention which is that, when it is user-cinched and in use, stabilizing and anchoring a helmet in place on a wearer's head, load distribution, in the form of strap tension, is substantially bilaterally load-balanced, with no harness strap component being either noticeably slack, or noticeably over-tensed, in relation to its "mirror-image", bilateral matching companion component. This quality is also generally lacking in prior art structures, especially where rigid-body, strap-connection hardware of the type generally mentioned just above is employed, and/or where the point of connection between the effective lateral end of a chin-strap unit per se is anchored in a fixed-position manner to the usual pair of lateral strap, or strap-like, structures which typically anchor directly to the shell of a helmet.

The concepts of bilateral load balancing, and of load-balanced centering, as employed herein, are intended to relate to a situation wherein, with the invention in use in relation to an associated user-worn helmet, all of the flex-strap components of the invention have self adjusted (during user cinching) to conditions in which different "length parts" of these components effectively meet and connect with one another at two, three-way points of intersection disposed on opposite sides of the helmet, and: (a) each length part extending away from each such point of intersection is substantially purely in tension; and (b) at each point of intersection, there is no tendency of a force carried in any one of such length parts to urge a shifting of the intersection point relative to either of the other two length parts which extend away from that same intersection point. These concepts also include the idea that like portions of the flex-strap components of the invention, disposed on opposite sides of an associated helmet which is in use, carry substantially equal tension loads.

A typical chin-strap harness, including even quite recent entrants into this field of technology, features a pair of strap-like side-strap components, each usually formed with a pair of elongate, defined-length, fixed-angularly-intersecting, lateral strap sub-components which, at their region of fixed angular intersection, intentionally furnish fixed anchoring locations for securement of the outer ends of the usual pair of releasably length-interconnectable, elongate chin-strap elements which together make up a chin-strap unit, or substructure. The term "length-interconnectable" is used herein to describe an arrangement wherein a chin-strap unit achieves its full length through the use of a rigid-body, releasable connection device which, in a lengthwise context, fastens two adjacent ends of two elongate elements which are brought together to create a fully assembled, full-length chin-strap unit.

An illustration of such a recently introduced harness structure is found in the helmet system which is disclosed in U.S. Pat. No. 6,804,829 B2, issued Oct. 19, 2004 to Crye et al. The spaced ends of the side-strap sub-components employed in this system, which sub-components are rigid and springy rather than flex-strap and fabric-like, are anchored, in a very traditional manner, to pairs of essentially fixed-position points appropriately provided on the inside of a specialized helmet shell component. The length-interconnectable chin-strap elements employed also in this system, when interconnected to form, collectively, an overall chin-strap substructure, cooperate to provide chin-engaging componentry which is supposed to center accurately on the wearer's chin.

The disadvantages of this kind of conventional arrangement, in its various forms (with rigid or flexible side-strap sub-components), are numerous. To begin with, proper positional placement of that portion of the chin-strap which is intended to center upon and engage the chin is notably difficult to achieve, particularly in the situations where flexible fabric-like side straps are involved. Adjustments to accomplish "load-balanced" centering are often quite challenging. Fixedness of the locations where the outer ends of chin-strap elements connect to the two, lateral side-strap sub-components contributes both to this centering problem, and to the fact that the two pre-fixed-length elongate portions of such sub-components rarely share equally in tension load-bearing when a chin-strap is tightened against a wearer's chin. In point of fact, one or the other of these fixed-length portions in each side strap is often quite slack. Such a condition leads either (a) to helmet instability on the head, (b) to strange angular "cocking" of a helmet on the head in a manner which, because of conventional design, as distinguished from that of the present invention, laterally imbalances load-sharing in a helmet harness structure, and thus undesirably imbalances load-cushioning for the head, or (c) to both. Adjustment to correct this kind of condition, and to keep all parts of a helmet, including the importantly cooperating chin-strap substructure and shell-internal, load-cushioning structure (usually shock-absorbing pads), properly shock-absorbingly positioned relative to one another, and especially so when the associated helmet may be cocked at an "odd angle" on the head, often is just not possible because of the precommitted fixed (defined) lengths of the side-strap sub-components The releasable length-interconnection mechanism which is most often supplied for coupling the usual two chin-strap elements is (a) typically quite bulky, (b) normally offset to one side of the chin and jaw when the chin-strap elements are coupled for use (see for example what is illustrated in the mentioned '829 patent), and (c) notably easily breakable. Its presence, in addition to being often quite uncomfortable, in that it bears as a "protrusion/enlargement" against one side of the face, results (a) in significant non-bilateral symmetry in overall harness disposition and performance, and, relatedly (b), in appreciable non-uniformity with respect to flexibilities and performance responses of the two lateral sides of a chin-strap harness because of the introduced, nonflexible rigidity which exists in the interconnect mechanism per se.

Another important drawback regarding prior art helmet harness structures is that they may enhance springiness in the manner in which an associated helmet system engages a wearer's head. Contrary to the long-standing, conventional-approach belief that springiness is an asset in handling shock cushioning, it is actually a serious and dangerous detriment. It amplifies rather than moderates a shock event. A good illustration of this problem of enhancement is found in the above-referred-to '829 patent which includes a pair of rigid and springy fixed (nominally) angular side members to which a chin-strap unit is attached.

Another issue presented by the '829 patent structure is that the specific force carried in each "leg" of each of the rigid, springy side members can tend to try to shift the point of three-way intersection existing between the other leg in that side member and the associated, connected of the chin-strap unit. Thus, this situation disables the '829 structure from predictably achieving and implementing the concept of load balancing described above in relation to the present invention.

The chin-strap harness of the present invention definitively addresses all of these conventional-structure disadvantages.

As will become clear from the detailed description of the invention which follows below, and especially when this description is read in conjunction with the accompanying drawings, the structure of the present invention features (a) simple and complete bilateral symmetry in all load-balancing respects, including the unique structural-symmetry symmetriflex and symmetriload qualities mentioned earlier herein, (b) sliding rather than fixed connections between flexible and pliable side straps and the opposite ends of a chin-strap substructure, (c) non-fixedness in the relative lengths, and in the angularities of intersections between "legs", of the harness side straps (they are fabric-flexible), (d) automatic self-load-balancing "centering" for the chin-strap substructure which is unitary in nature, and (e), as just suggested earlier, substantially symmetriload, and symmetriflex load-handling by the elongate portions (the "legs") in the side-strap "lengths" which extend away from the points of sliding connections established with the outer, laterally-load-balanced ends of the chin-strap substructure.

Other features and advantages, such as structural simplicity, the absence of anything which might introduce, or contribute to springiness into the cooperative behavior of the invention with a helmet shell, and ease of use with a wide variety of helmets, will also become clearly apparent as the description of this invention now unfolds.

DETAILED DESCRIPTION OF THE INVENTION

Figure 2:
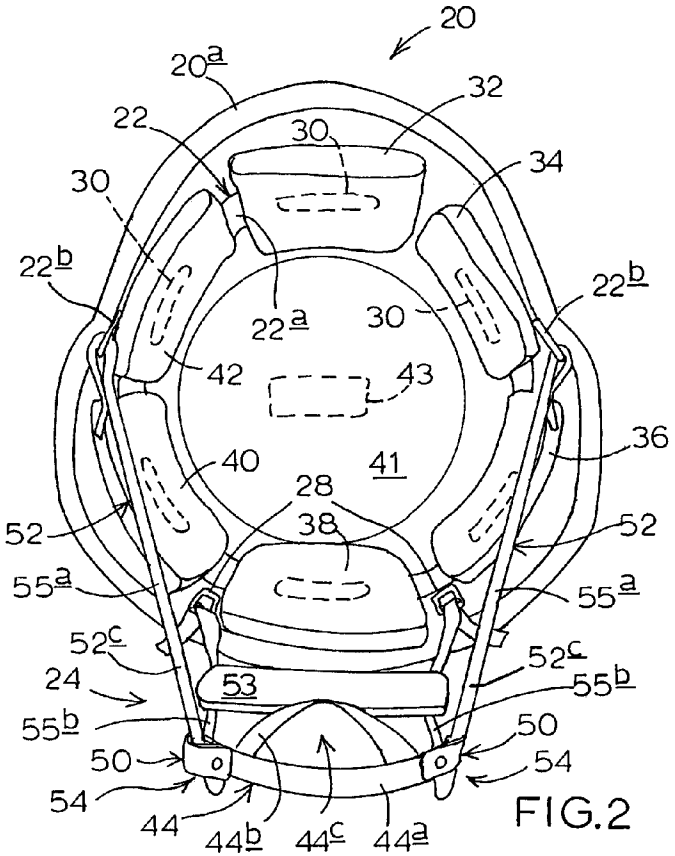
FIG. 2 is a bottom plan, solid-line view of the helmet of FIG. 1, with the above-mentioned load-cushioning pads shown in place.
Figure 1:
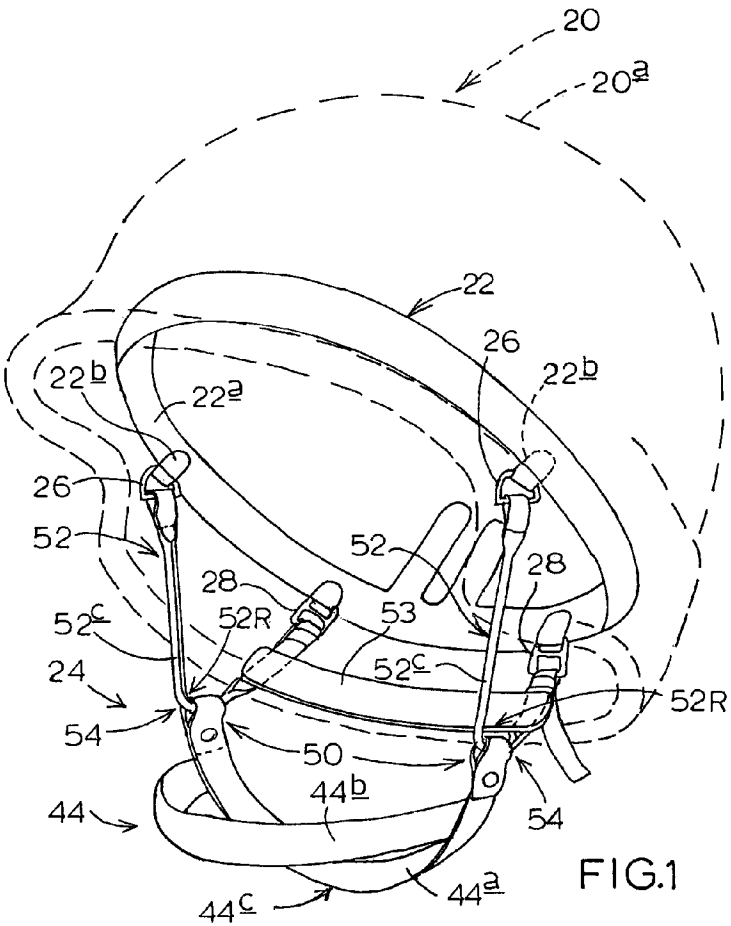
FIG. 1 is a bottom isometric view (in dashed lines) of a military helmet which is equipped with harness structure (in solid lines) constructed in accordance with a preferred and best mode embodiment of the present invention. A portion of the shell in this helmet has been broken away to reveal certain details involving the construction and installation of the invention. Load-cushioning pads which are deployed inside the shell of this helmet have been omitted in this figure.
Figure 5:
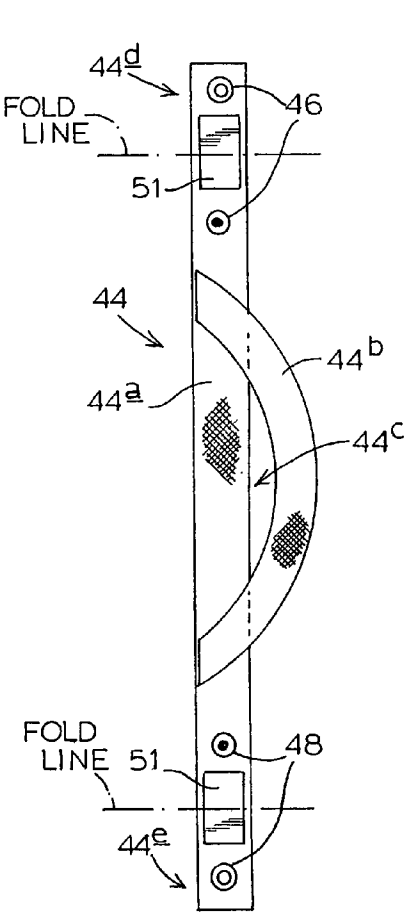
FIG. 5 pictures an isolated, unitary, bilaterally symmetric and non-rigid chin-strap substructure employed in the invention.
Figure 4:
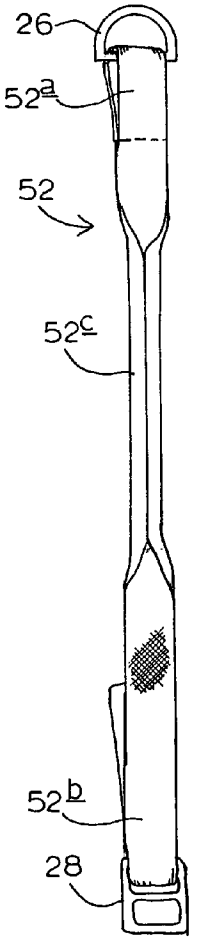
FIG. 4 illustrates, in a flattened, or developed, view, an isolated one of a pair of flex-fabric, ribbon-like, side-strap elements which forms part of the invention. These elements are also referred to herein collectively as equi-flex, non-rigid, fabric-strap-like, substantially mirror-image, flexible lateral elements which define opposite sides of the harness structure of the invention. The single lateral element specifically illustrated in this figure is shown connected to the hardware through which it effectively connects to the shell of the helmet of FIGS. 1-3, inclusive.
Figure 3:
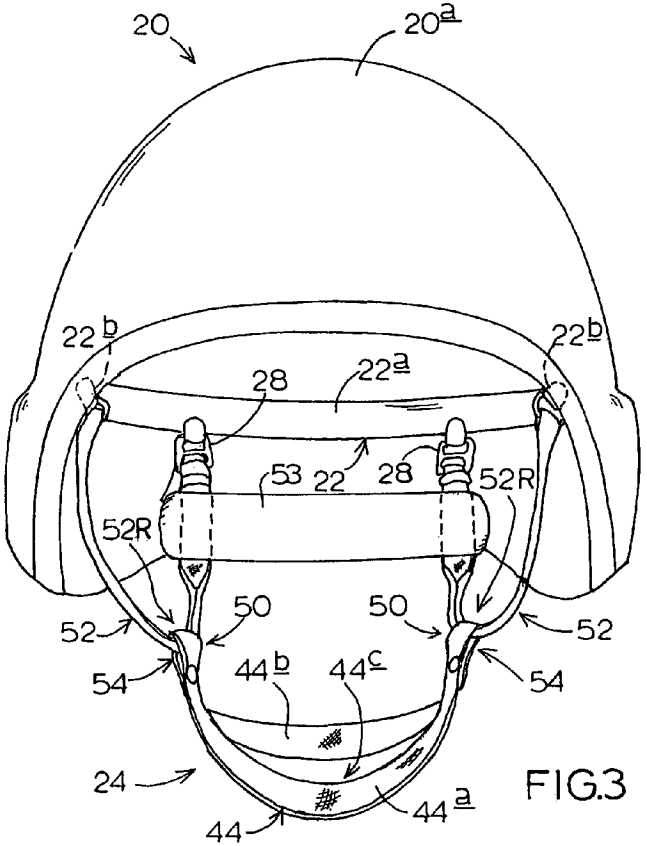
FIG. 3 is a front elevation of the helmet shown in FIGS. 1 and 2.

Beginning with attention directed to FIGS. 1-3, inclusive, in the drawings, shown generally at 20 is a military helmet having a shell 20*a*, on the inside of which, in the particular helmet illustrated herein, is an appropriately anchored, wrap-around suspension, or suspension frame, 22 made, for example, in accordance with the teachings of U.S. Pat. No. 6,681,402 B2, issued Jan. 27, 2004 for "Helmet Liner Suspension Structure", the content of which is hereby incorporated herein by reference. Suspension 22 is employed, as will be explained shortly, to support the harness structure of the present invention, as well as a head-cushioning pad system. It should be understood that while various attachments are illustrated and described herein in the context of the presence of suspension 22, the use of such a suspension is not required by, or part of, the present invention, and all such attachments could be made differently, as for example, directly to the shell of a helmet, such as to shell 20*a*. Helmet shell 20*a*, as illustrated in FIG. 1, and as was mentioned earlier, is shown in dashed lines in order to reveal certain details of the construction and helmet-shell installation of a helmet chin-strap harness, or system, 24 which is made in accordance with a preferred and best mode embodiment of the present invention.

Suspension 22 features an elongate band 22*a* which is directly secured to the inside of shell 20*a*. Band 22*a* includes a pair of forward, lateral, strap-end attaching structures 22*b* which loosely but capturingly receive and hold a pair of freely dangling, conventional D-rings, shown at 26 in FIG. 1. While D-ring use is very convenient in the implementation and practice of the present invention, it is not a requirement. Simple pivot connections (not specifically shown), for example, could be used instead.

Also carried on band 22*a*, near the rear of shell 20*a*, are two, additional strap-end attaching devices, generally shown at 28, which are also, per se, conventional in design. Devices 28 are of any appropriate type which accommodates quick-release, strap-end securement. Devices 28 also receive the ends of attached straps in a manner which allows for adjustable "push-pull tightening and loosening" to set and release desired tension in an attached strap. Additionally, devices 28 allow for a certain freedom of rocking or pivoting motion for the ends of straps attached to them relative to suspension band 22*a*.

Band 22*a* herein also carries an appropriate distribution, six herein, of one of the two, usual "operative parts" of conventional hook-and-pile fastening elements 30 several of which are shown in dashed lines in FIG. 2. It is to these elements that plural, six herein also, acceleration-rate-sensitive, non-springy, head-engaging, shock-absorbing cushioning pads 32, 34, 36, 38, 40, 42, are removably and repositionably attachable. These pads are preferably, but not necessarily, made in accordance with the teachings of U.S. Pat. No. 6,467,099 B2, issued Oct. 22, 2002 to cover an invention entitled "Body-Contact Cushioning Interface Structure". An overhead central cushioning pad is shown at 41, removeably attached to the central, upper inside surface of helmet shell 20*a* by hook-and-pile fastening structure 43.

Depending upon the dispositions and actual "population" of pads in place at any given time inside shell 20*a*, and also depending upon the particular manner of helmet placement on the wearer's head, it is always important, no matter these other conditions involving population and dispositions, that the act of securing of the helmet in place, by cinching, or tightening, of the chin-strap harness structure of the invention, results in comfortable and proper load-balancing and distribution throughout the entire "head-engaging" system (the harness structure of this invention, and the mentioned head-engaging cushioning pads). This important consideration depends, in large part, on the balance and symmetricity of conditions in the chin-strap harness-structure portion of that overall, cooperative system. Conventional chin-strap harness structures do not usually achieve/accomplish this condition except either (a) under pure chance circumstances, or (b) on account of elaborate, purposeful and time-consuming wearer-adjustments, often required under difficult and/or inconvenient conditions.

The present harness-structure invention, which definitively addresses this consideration, as well as others, additionally, and very importantly, does not introduce, or contribute to, any springiness in the behavior of a helmet system in which it is incorporated.

All of the features and performance advantages of the invention are described now in detail with reference made throughout generally to all of the drawing figures.

Thus, included in harness, or harness structure, 24 is a central chin-strap unit, or substructure, 44 which is made up of two elongate, but different-length, stitched-together straps 44*a*, 44*b* which form a chin-reception cup 44*c*. Opposite ends 44*d*, 44*e* of longer strap 44*a*, which strap ends collectively define the opposite ends of unit 44, are prepared with conventional, two-part, interconnectable, releasable snaps, or so-called "pull-the-dot" fasteners, 46, 48 which accommodate the formations of closed, reverse-bend loops, such as those shown at 50 in FIGS. 1-3, inclusive, and 5. Importantly, and in accordance with a special feature of the present invention, unit 44 is bilaterally symmetrical. Additionally, and as will become appreciated, unit 44 is attached in the overall assembled structure of harness 24 without the use of any additional rigid-bodied, "one-sided" hardware, such as the rigid-bodied interconnection device which is shown at 88 in the '829 patent.

Attached as by stitching to the portions of strap ends 44*d*, 44*e* which form the insides of loops 50 are small patches 51 of a frictioning material, such as TOUGH TEK®. This frictioning material plays a role in the cinching behavior of the invention in a manner which will be explained shortly.

Also included in harness 24 are two, elongate, lateral chin-strap-unit support straps, or ribbon-like elements, 52, each of which, intermediate its opposite ends 52*a*, 52*b*, includes a reduced-dimension region, or length portion, 52*c* formed by rolling, and stitching to stabilize, a bi-folded length of the strap along and about its own long axis. It is around regions 52*c*, which are also referred to herein as translation slide regions, that the opposite ends of strap 44*a* are closed-looped (see 50), as illustrated in FIGS. 1-3, inclusive, and 6, to establish relative-motion sliding connections for the opposite ends of chin-strap unit 44 on the two lateral straps. This arrangement is one of the important features of the present invention. Elements 52, which effectively define opposite sides of structure 24, are fabric-like in nature, are very flexible/pliable in behavior, and preferably are formed of a material such as nylon webbing.

Figure 7:
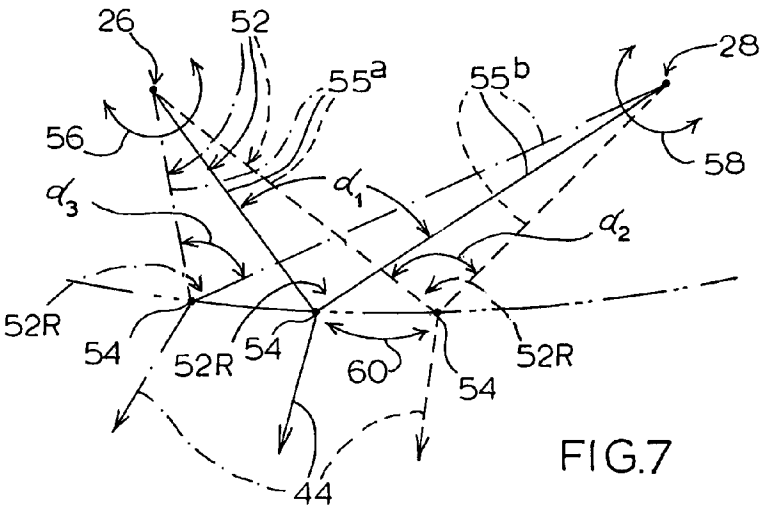
FIG. 7 is a stylized diagram illustrating, from the point of view of one side of the harness structure of the present invention, the fundamental way in which self-adjusting, load-balancing, laterally-symmetric (symmetriflex and symmetriload) performance is achieved.
Figure 6:
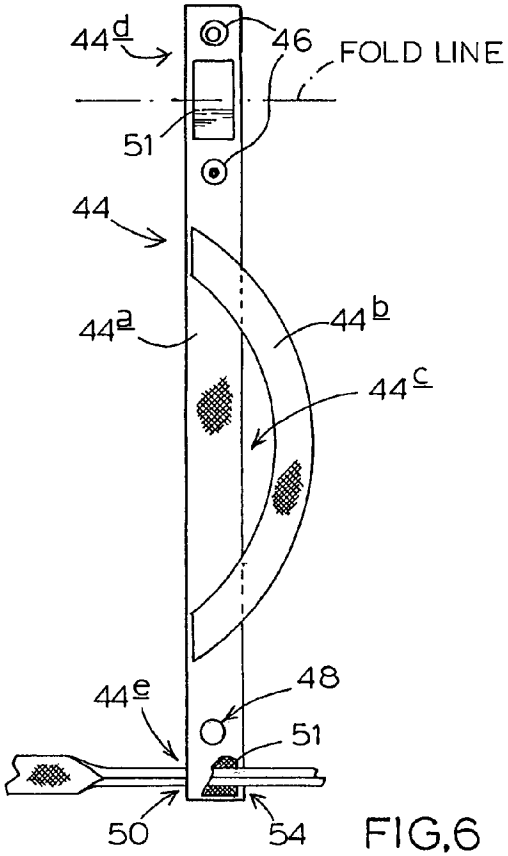
FIG. 6 shows a fragment of the side-strap component of FIG. 4 and the chin-strap substructure of FIG. 5 laterally, slideably interconnected in the manner featured by the invention. Specifically, these two components are slideably interconnected to permit fore-and-aft translational sliding of the chin-strap substructure relative to the side-strap component.

Regions 52*c* in elements 52 are also referred to herein as translation slide regions. The specific points of operative connections which exist between elements 52 and the opposite ends of chin-strap unit 44, such as those points of connection designated 54 in the drawings, are referred to herein as zones of connected intersection, and also as points of three-way intersection. In these zones, elements 52, and specifically regions 52*c*, pass through the zones in reverse bends, as can be seen especially in FIGS. 1-3, inclusive, and 7 at 52R (only a few are labeled in the drawings). From these reverse bends, and because of the fact that zones 54 are shiftable in nature on account of the sliding connections described, the regions 55*a*, 55*b* of elements 52 (see FIGS. 2 and 7) which extend away from these reverse bends, referred to herein as length stretches, do so at different "angles of intersection", depending upon the specific locations of zones 54. These two regions (55*a*, 55*b*) also extend away from the mentioned reverse bends with self-determining, differing relative lengths, which lengths also depend upon the specific locations of zones 54. Prior art structures are not known which exhibit these important characteristics. These features relating to elements 52 are best illustrated in FIG. 7 which shows three different positions for zones 54.

The opposite ends of elements 52 attach to suspension 22 both through D-rings 26 and attaching devices 28. More specifically, ends 52*a* in these elements are looped around, and stitched together with respect to, the D-rings. Ends 52*b* are made to be freely and selectively connectable with and disconnectable from attaching devices 28. These ends (52*b*), when so connected to devices 28, may be pushed/pulled, and conventionally friction-locked, to establish secure cinching of the chin-strap harness structure of this invention for the purpose of securing a helmet (such as helmet 20) in place properly on a wearer's head. The details of construction of devices 28 are not relevant to the invention.

Suitably mounted on elements 52, near devices 28, is a rear, laterally extending, elongate nape band 53 which is conventional in construction. Band 53 functions in a well-known manner to utilize contact with the nape of a wearer to assist in stabilizing a helmet in place when the associated harness, such as harness 24, is in a fully cinched condition.

What will now be noticeable immediately about the chin-strap harness structure of this invention is that, when it is assembled and in a condition for use, and when the rear ends of elements 52 are pulled to cinch the entire helmet "system" in place, the chin-strap harness structure of the invention automatically self-seeks a disposition wherein it establishes, effectively, proper load-balanced bilateral symmetry throughout. More specifically, it possesses such symmetry both structurally and functionally. Flexibility/pliability in the components of the harness structure results (a) in the positions of zones 54 sliding to locations which "recognize" any unusual angular cocking of the helmet shell in any direction, and (b) in the associated lengths of element stretches 55*a*, 55*b* adjusting accordingly to achieve desirable, bilateral balanced conditions of internal tension (symmetriflexing/symmetriloading, so-to-speak). This behavior results then in proper "loading" of the conditions of contact engagements of the load-cushioning, shock-absorbing pads with the wearer's head.

With elements 52 secured to suspension 22 as described, the ends of these elements are not constrained to having only one "locked" disposition relative to that suspension. Rather, these ends can rock freely relative to their respective points of attachment to accommodate, along with the two described sliding connections existing between elements 52 and chin-strap unit 44, shifting of the zones (54) of connected intersection without any undesirable deformation, such as buckling, taking place in the elements. Thus, the very undesirable prior art conditions of lateral strap slacking and over-tensing cannot occur. These conditions cannot develop inasmuch as the "points" of interconnection between lateral elements 52 and chin-strap unit 44 are not dedicatedly locked to particular locations along the lengths of the lateral elements. Thus, the "stretch" regions 55*a*, 55*b* of elements 52 on each side of the harness are freely relatively changeable as (a) the sliding connections in moveable zones 54 shift positionally, and (b) the effective angles of intersection between these stretch regions self-adjust accordingly.

Focusing for a moment particularly on FIG. 7, here, a single lateral element is shown schematically in three different conditions with structure 24 cinched in place relative to helmet 20 and a wearer. Solid lines show one condition; dashed lines show another condition; and dash-dot lines show a third condition. The regions of attachment of the opposite ends of this element 52 are represented by dots labeled 26, 28 which relate to a D-ring 26 and an attaching device 28, respectively. Three additional dots, all labeled 54, picture three different positions for the above-described intersection zones 54. Arrow-headed solid lines, dashed-lines and dash-dot lines, all labeled 44, represent a connected end of chin-strap unit 44.

What can clearly be seen in FIG. 7, in an exaggerated-presentation way, is how, in the different illustrated positions of zone 54, the relative lengths of regions 55*a*, 55*b* in element 52, and the intersection angles $\alpha_1$, $\alpha_2$, $\alpha_3$ between regions 55*a*, 55*b*, change as the position of zone 54 "moves" along a path 57 (shown as a dash-double-dot line). Path 57 can be thought of as being defined by fore-and-aft shifting of the position of zone 54 under a circumstance with the entirety of element 52 maintained in tension. Angles $\alpha_1$, $\alpha_2$, $\alpha_3$ relate, respectively, to the solid-line, dashed-line, and dash-dot line positions shown for regions 55*a*, 55*b* in element 52.

These important features of the invention enable it to perform with the structural and performance characteristics which been referred to hereinabove as bilateral symmetriflex and symmetriload capabilities.

Thus, the harness of this invention, in a kind of automatic and self-adjusting manner, and when operated (very simply by pulling on the rear ends 52*b* in elements 52) to cinch into place an associated helmet shell and its installed load-cushioning pad structure, self-functions essentially to establish immediate, functional, load-balancing symmetry in relation to helmet-system engagement with the head.

FIG. 7 in the drawings, which shows schematically several different "adjusted" and "cinched" harness-component dispositions on one side of the harness and helmet 20 (as was mentioned earlier herein), helps especially to illustrate this and various other operational and functional statements regarding the invention set forth in the discussions above. For example, double-headed curved arrows 56, 58 in this figure picture various motions that are permitted to the opposite ends 52*a*, 52*b*, of elements 52 relative to their points of attachment to suspension 22, and thus to helmet shell 20*a*. A slightly curved, double-headed arrow 60 illustrates the sliding, relative-motion connection which exists between an end loop 50 of chin-strap unit 44 and the reduced-dimension region 52*c* of a lateral strap element 52.

It will thus be apparent that when a wearer dons a helmet equipped with the chin-strap harness structure of this invention, and cinches tight with that structure by pulling on, and thereby adjusting, the rear ends of the lateral strap elements in the harness adjacent attaching devices 28, the several components which make up the harness will automatically adjust freely and automatically to accommodate proper load-balanced, load-distributing seating and securing of the helmet on the wearer's head. This will occur with the various flexible and pliable strap components in the harness all effectively self-adjusting to share in the symmetriload/symmetriflex tension-balancing, and "carrying", of the securing "force" set by the wearer. Before fully tight cinching occurs, loops 50 can shift relatively freely along lateral element regions 52*c*. As cinching tightness is close-approached, these loops begin to close, with frictioning patches 51 then progressively adjusting toward conditions of frictional gripping and positional locking of the opposite ends of chin-strap unit 44 on elements 52.

Thus, a unique, self-balancing, chin-strap helmet-system harness structure has been described and illustrated, and certain recognized variations and modifications suggested. Those skilled in the art will certainly appreciate that other variations and modifications are possible without departing from the spirit of the invention, and we fully intend that the following claims to invention be interpreted to cover all such other, related structures and methodologies.

We claim:

1. Helmet chin-strap harness structure comprising a pair of bilaterally symmetric, bilaterally equi-flex, non-rigid, fabric-strap substantially mirror-image, flexible lateral elements which define opposite sides for the harness structure, and which include, one each, elongate translation slide regions, and a bilaterally symmetric chin-strap substructure having laterally opposite sides releasably attachable through included reverse bends, having inside attached frictioning patches, for fore-and-aft translational, relative-motion sliding on, and cinch-positional-locking relative to, said slide regions in said lateral elements, said bends and patches being structured for closing progressively upon said slide regions during cinching of the harness structure, thus progressively to inhibit relative-motion sliding between said slide regions and said bends and patches in said chin-strap substructure.

2. The harness structure of claim 1, wherein each of said lateral elements has opposite ends, and which further comprises, on each of its opposite sides, and when said chin-strap substructure and said elements are releasably attached, a shiftable zone of connected intersection established between the length portion of the element which is disposed on that side and the associated chin-strap substructure side, and the position of that zone defines both (a) a pair of lateral, adjoining length stretches in said element and the respective lengths thereof, and (b) an angle of intersection between said length stretches.

3. The harness structure of claim 1 which is characterized structurally by bilateral symmetriflex and symmetriload capability.

4. Helmet chin-strap harness structure for use with a helmet having a front portion, spaced-apart sides and a rear portion comprising a pair of bilaterally symmetric, bilaterally equi-flex, non-rigid, fabric-strap substantially mirror-image, flexible lateral elements, wherein one end of each lateral element is attached to the helmet along a side thereof and the other end of each lateral element is attached to the rear portion of the helmet, which define opposite sides for the harness structure, and which include, one each, elongate translation slide regions, and a bilaterally symmetric chin-strap substructure having laterally opposite sides releasably attachable through included reverse bends, having inside attached frictioning patches located on an interior surface of said reverse bends, for fore-and-aft translational, relative-motion sliding on, and cinch-positional-locking relative to, said slide regions in said lateral elements, said bends and patches being structured for closing progressively upon said slide regions during cinching of the harness structure, thus progressively to inhibit relative-motion sliding between said slide regions and said bends and patches in said chin-strap substructure.

5. The harness structure of claim 4, wherein each of said lateral elements has opposite ends, and which further comprises, on each of its opposite sides, and when said chin-strap substructure and said elements are releasably attached, a shiftable zone of connected intersection established between the length portion of the element which is disposed on that side and the associated chin-strap substructure side, and the position of that zone defines both (a) a pair of lateral, adjoining length stretches in said element and the respective lengths thereof, and (b) an angle of intersection between said length stretches.

6. The harness structure of claim 4 which is characterized structurally by bilateral symmetriflex and symmetriload capability.

7. Helmet chin-strap harness structure for use with a helmet having a front portion, spaced-apart sides and a rear portion comprising a pair of bilaterally symmetric, bilaterally equi-flex, non-rigid, fabric-strap substantially mirror-image, flexible lateral elements which define opposite sides for the harness structure, and which include, one each, elongate translation slide regions, and a bilaterally symmetric chin-strap substructure having laterally opposite sides releasably attachable through included reverse bends, having inside attached frictioning patches located on an interior surface of said reverse bends, for fore-and-aft translational, relative-motion sliding on, and cinch-positional-locking relative to, said slide regions in said lateral elements, said bends and patches being structured for closing progressively upon said slide regions during cinching of the harness structure, thus progressively to inhibit relative-motion sliding between said slide regions and said bends and patches in said chin-strap substructure.

8. The harness structure of claim 7, wherein each of said lateral elements has opposite ends, and which further comprises, on each of its opposite sides, and when said chin-strap substructure and said elements are releasably attached, a shiftable zone of connected intersection established between the length portion of the element which is disposed on that side and the associated chin-strap substructure side, and the position of that zone defines both (a) a pair of lateral, adjoining length stretches in said element and the respective lengths thereof, and (b) an angle of intersection between said length stretches.

9. The harness structure of claim 7 which is characterized structurally by bilateral symmetriflex and symmetriload capability.

* * * * *